US005406363A

United States Patent [19]

Siegel et al.

[11] Patent Number: 5,406,363

[45] Date of Patent: Apr. 11, 1995

[54] PREDICTIVE FUSER MISSTRIP AVOIDANCE SYSTEM AND METHOD

[75] Inventors: Robert P. Siegel, Penfield; Edward C. Hanslik, Fairport; Paul M. Fromm, Rochester; Rabin Moser, Victor, all of N.Y.

[73] Assignee: Xerox Corporation, Stamford, Conn.

[21] Appl. No.: 169,098

[22] Filed: Dec. 20, 1993

[51] Int. Cl.[6] ..... G03G 13/20; G03G 21/00

[52] U.S. Cl. ..... 355/290; 355/208; 355/282; 355/295

[58] Field of Search ..... 355/282, 284, 285, 290, 355/295, 203, 204, 208; 271/307, 308, 309, 310, 311, 312; 219/216; 118/60

[56] References Cited

U.S. PATENT DOCUMENTS

| | | | |
|---|---|---|---|
| 3,957,423 | 5/1976 | Mueller | 432/60 |
| 3,981,085 | 9/1976 | Franko | 355/285 X |
| 3,991,999 | 11/1976 | Brooke | 271/308 |
| 4,028,050 | 6/1977 | Bar-on | 432/59 |
| 4,156,524 | 5/1979 | Bar-on et al. | 271/311 |
| 4,332,457 | 6/1982 | Mitsuyama et al. | 355/295 X |
| 4,525,058 | 6/1985 | Hirabayashi et al. | 355/282 |
| 4,593,992 | 7/1986 | Yoshinaga et al. | 355/284 |
| 4,684,784 | 8/1987 | Tamary | 219/216 |
| 4,771,310 | 9/1988 | Leo et al. | 271/311 X |
| 4,813,868 | 3/1989 | Soga | 219/216 X |
| 4,942,433 | 7/1990 | Stuart | 355/284 |
| 5,053,830 | 10/1991 | Arai | 355/290 |
| 5,099,289 | 3/1992 | Kurotori | 355/290 |
| 5,161,796 | 11/1992 | Okamoto | 271/308 |
| 5,221,948 | 6/1993 | Dalal | 355/284 |
| 5,307,134 | 4/1994 | Nakajima et al. | 355/285 |

FOREIGN PATENT DOCUMENTS 0164075 7/1987 Japan .

*Primary Examiner*—A. T. Grimley
*Assistant Examiner*—Sandra L. Brasé
*Attorney, Agent, or Firm*—Kevin R. Kepner

[57] ABSTRACT

An apparatus for minimizing fuser misstrips from a heat and pressure fuser in an electrophotographic printing machine. A plurality of sensors are provided to determine the basis weight of the copy sheet, the density of the image being transferred to the copy sheet and fused thereon, the relative humidity of the machine environment, the process speed of the print engine, etc. Signals indicative of all the variables are generated and sent to the machine controller which processes these signals and predicts when a fuser misstrip is likely to occur. Based on the likely degree of misstrip, a variety of actions are taken to prevent the misstrip. A stripper finger can be actuated to physically remove the sheet from the fuser member and/or the release agent management system can vary the amount of release agent applied to the fuser to assist in the removal of the copy sheet from the heated fuser member. The overall system provides the advantage of a varying amount of fuser release agent so that an extreme buildup of oil is not encountered, and further allows an intermittent stripper finger use to prevent premature wear of the fuser member by the constant pressure of a stripper finger.

25 Claims, 3 Drawing Sheets

INPUT MEMBERSHIP - PAPER BASIS WEIGHT

INPUT MEMBERSHIP - ENVIRONMENT (RH)

INPUT MEMBERSHIP - IMAGE DENSITY

PREDICTIVE FUSER MISSTRIP AVOIDANCE SYSTEM AND METHOD

This invention relates generally to a method and apparatus for preventing fuser misstrips, and more particularly concerns a predictive system and method to minimize copy sheet wraps on a heat and pressure fusing roll in an electrophotographic printing machine.

In a typical electrophotographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip. Typical of such fusing devices are two roll systems wherein the fusing roll is coated with an elastic material, such as a silicone rubber or other low surface energy elastomer or, for example, tetrafluoroethylene resin sold by E. I. DuPont De Nemours under the trademark Teflon. In these fusing systems, however, since the toner image is tackified by heat, it frequently happens that a part of the image carried on the supporting substrate will be retained by the heated fuser roller and not penetrate into the substrate surface. The tackified toner may stick to the surface of the fuser roll and offset to a subsequent sheet of support substrate or offset to the pressure roll when there is no sheet passing through a fuser nip resulting in contamination of the pressure roll with subsequent offset of toner from the pressure roll to the image substrate. The sheet may also stick to the fuser roll and cause a condition known as misstrip or fuser wrap.

To obviate the foregoing toner offset and misstrip problem, it has been common practice to utilize toner release agents such as silicone oil, in particular, polydimethyl silicone oil, which is applied to the fuser roll surface to a thickness of the order of about 1 micron to act as a toner release material. These materials possess a relatively low surface energy and have been found to be materials that are suitable for use in the heated fuser roll environment. In practice, a thin layer of silicone oil is applied to the surface of the heated roll to form an interface between the roll surface and the toner image carried on the support material. Thus, a low surface energy, easily parted layer is presented to the toners that pass through the fuser nip and thereby prevents toner from adhering to the fuser roll surface. Apparatus for applying the release agent material to a fuser member is commonly referred to as a release agent management (RAM) system.

Mechanical stripper fingers are also used to assist in preventing fuser misstrips. In printing machines which utilize stripper fingers to assist in the removal of the fixed toner image copy sheet from the fuser roll, there is often a buildup of release agent at the location of the stripper fingers. This buildup can cause a transfer of the release agent to the copy sheets thereby creating defective copies. Stripper fingers can also cause localized wear of the relatively soft fuser roll due to the constant pressure by the finger on the roll. It is, therefore, desirable to apply less release agent in the area on the fuser corresponding to the stripper finger while still applying enough release agent to prevent toner offset.

In full process color printing machines, there are typically at least two process speed modes, a high speed mode for black or monochrome and a slow speed for full color. There may also be an even slower, third mode for printing items such as transparencies. As a result of these varying modes, it is necessary to provide different fuser oil rates for the different modes. In the slow speed modes the fuser requires a higher rate of oil to obtain optimum performance. Typically, however, RAM systems provide less oil at slower speeds which can exacerbate the problem of fuser misstrips.

It is desirable to provide a system that can predict when the occurrence of a misstrip is likely based on parameters such as toner density, sheet weight, fusing speed, relative humidity of the fusing area, etc. and take action to prevent or minimize misstrips.

The following disclosures may be relevant to various aspects of the present invention:

U.S. Pat. No. 5,221,948 Patentee: Dalal Issue Date: Jun. 22, 1993

U.S. Pat. No. 5,099,289 Patentee: Kurotori, et al Issue Date: Mar. 24, 1992

U.S. Pat. No. 4,942,433 Patentee: Stuart Issue Date: Jul. 17, 1990

U.S. Pat. No. 4,593,992 Patentee: Yoshinaga, et ano. Issue Date: Jun. 10, 1986

U.S. Pat. No. 4,156,524 Patentee: Bar-on et al. Issue Date: May 29, 1979

U.S. Pat. No. 4,028,050 Patentee: Bar-on Issue Date: Jun. 7, 1977

U.S. Pat. No. 3,957,423 Patentee: Mueller Issue Date: May 18, 1976

JP-A-164,075 Patentee: Aoki Issue Date: Jul. 20, 1987

U.S. Ser. No. 07/870,966 Inventor: Fromm, et al. Filing Date: Apr. 20, 1992

The relevant portions of the foregoing disclosures may be briefly summarized as follows:

U.S. Pat. No. 5,221,948 discloses a release agent management (RAM) system including a heated fuser roll, a pressure roll, a sump containing a quantity of release agent, a pair of metering rolls and a donor roll. Each of the metering rolls is immersed in a quantity of release agent and is able to selectively be brought into contact with the donor roll. The donor roll acts as the transport to transfer release agent from either or both of the metering rolls to the heated fuser roll. The dual roll metering system provides a RAM system which can uniformly provide two or more oiling rates varying with the process speed of the printing machine.

U.S. Pat. No. 5,099,289 discloses a fuser silicone oil dispenser which utilizes a metering member and a donor member and which is capable at operating in two modes to vary the amount of silicone oil delivered to the fuser.

U.S. Pat. No. 4,942,433 describes a release liquid applying device utilizing a rotating wick that is engaged by a fusing roller wherein the wick at times is prevented from rotating, thereby reducing the oil applied to the fuser roller.

U.S. Pat. No. 4,593,992 describes a device for intermittently applying the fuser release agent to the rotating fuser roll.

U.S. Pat. No. 4,156,524 discloses a sheet stripping mechanism in which the stripping blade is substantially coextensive with the dimension of the copy sheet. The blade is spring biased into contact with the fuser member and mounted so that the blade is substantially tangential to the heated surface of the fuser member during stripping.

U.S. Pat. No. 4,028,050 describes a stripping apparatus utilizing a plurality of biasly mounted stripper fingers. Each of the fingers contacts the heated fuser member and the position of each finger can be varied to alter the pressure exerted by the finger.

U.S. Pat. No. 3,957,423 discloses a stripper assembly having a plurality of pivotally mounted stripper fingers. Each of the fingers is mounted so that the weight of the copy sheet on the finger after stripping serves to minimize the adverse forces on the heated fuser element.

JP-A-164,075 describes a fuser assembly in which a solenoid actuated lever increases or decreases the amount of release agent applied to the fuser assembly by the donor member.

U.S. Ser. No. 07/870,966 describes a release agent management system including a metering roll and a donor roll in which a metering blade structure for metering silicone oil onto the metering roll has two modes of operation. In one mode, a wiping action of the metering blade meters a relatively large quantity of silicone oil to the roll surface and in the other mode of operation, a doctoring action is affected for metering a relatively small amount of silicone oil to the roll surface.

In accordance with one aspect of the present invention, there is provided a printing machine in which an unfused toner image is heat and pressure fused to a copy sheet. The improvement comprises means for determining at least one of a plurality of parameters effecting separating the sheet from the fuser and generating a signal indicative thereof. A plurality of sheet separating devices and a controller, responsive to the signal from said determining means, for selecting at least one of said plurality of sheet separating devices to separate the sheet from the fuser are also provided.

Pursuant to another aspect of the present invention, there is provided a method for predicting and preventing fuser misstrips in a printing machine. The method comprises the steps of determining at least one of a plurality of parameters effecting separating a sheet from the fuser and generating a parameter signal indicative thereof and selecting, in response to the parameter signal, at least one of a plurality of sheet separating devices to separate the sheet from the fuser. The step of then actuating at least one of a plurality of sheet separating devices for removing a sheet from the fuser is also included.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 3:
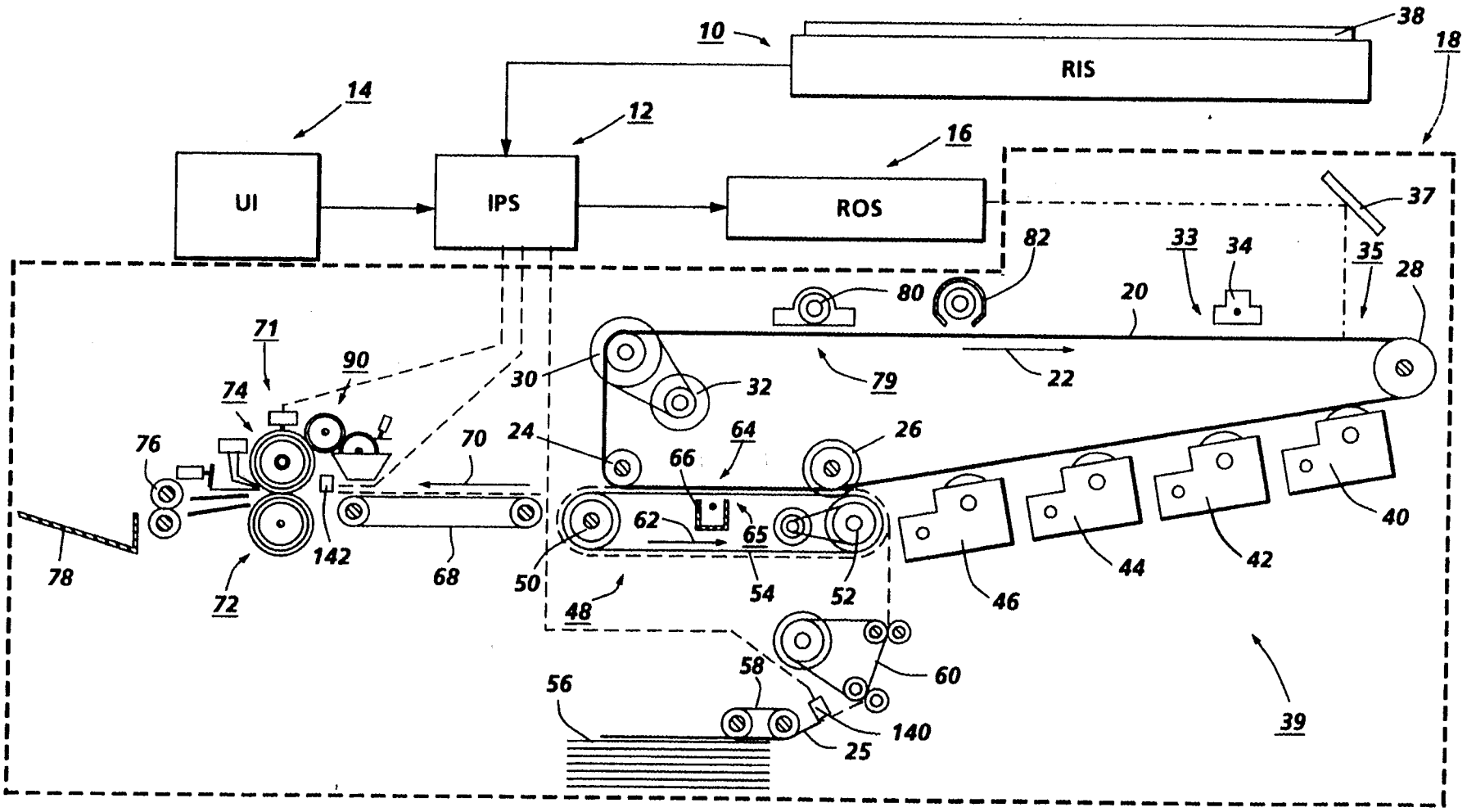
FIG. 3 is a schematic view of a full color electrophotographic printing machine incorporating the fuser assembly of FIG. 1.

For a general understanding of the features of the present invention, reference is made to the drawings. In the drawings, like references have been used throughout to designate identical elements. FIG. 3 is a schematic elevational view of an illustrative electrophotographic machine incorporating the features of the present invention therein. It will become evident from the following discussion that the present invention is equally well suited for use in a wide variety of printing systems, and is not necessarily limited in its application to the particular system shown herein.

Turning initially to FIG. 3, during operation of the printing system, a multi-color original document 38 is positioned on a raster input scanner (RIS) indicated generally by the reference numeral 10. The RIS contains document illumination lamps, optics, a mechanical scanning drive, and a charge coupled device (CCD array). The RIS captures the entire original document and converts it to a series of raster scan lines and measures a set of primary color densities, i.e. red, green and blue densities, at each point of the original document. This information is transmitted to controller 200 which includes an image processing system (IPS), indicated generally by the reference numeral 12. IPS 12 contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The output signal from UI 14 is transmitted to IPS 12. A signal corresponding to the desired image is transmitted from IPS 12 to ROS 16, which creates the output copy image. ROS 16 lays out the image in a series of horizontal scan lines with each line having a specified number of pixels per inch. ROS 16 includes a laser having a rotating polygon mirror block associated therewith. ROS 16 exposes a charged photoconductive belt 20 of a printer or marking engine, indicated generally by the reference numeral 18, to achieve a set of subtractive primary latent images. The latent images are developed with cyan, magenta, and yellow developer material, respectively. These developed images are transferred to a copy sheet in superimposed registration with one another to form a multicolored image on the copy sheet. This multi-colored image is then fused to the copy sheet forming a color copy.

With continued reference to FIG. 3, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform electrostatic potential.

Next, the charged photoconductive surface is moved through an exposure station, indicated generally by the reference numeral 35. Exposure station 35 receives a modulated light beam corresponding to information derived by RIS 10 having a multi-colored original document 38 positioned thereat. RIS 10 captures the entire image from the original document 38 and converts it to a series of raster scan lines which are transmitted as electrical signals to IPS 12. The electrical signals from RIS 10 correspond to the red, green and blue densities at each point in the original document. IPS 12 converts the set of red, green and blue density signals, i.e. the set of signals corresponding to the primary color densities of original document 38, to a set of colorimetric coordinates. The operator actuates the appropriate keys of UI 14 to adjust the parameters of the copy. UI 14 may be a touch screen, or any other suitable control panel, providing an operator interface with the system. The output signals from UI 14 are transmitted to IPS 12. The IPS then transmits signals corresponding to the desired image to ROS 16. ROS 16 includes a laser with rotating polygon mirror blocks. Preferably, a nine facet polygon is used. ROS 16 illuminates, via mirror 37, the charged portion of photoconductive belt 20 at a rate of about 400 pixels per inch. The ROS will expose the photoconductive belt to record three latent images. One latent image is developed with cyan developer material. Another latent image is developed with magenta developer material and the third latent image is developed with yellow developer material. The latent images formed by ROS 16 on the photoconductive belt correspond to the signals transmitted from IPS 12. A fourth latent image can also be recorded to be developed with black toner.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document and or to provide undercolor removal in a color image. Each of the developer units is moved into and out of an operative position. In the operative position, the magnetic brush is closely adjacent the photoconductive belt, while in the non-operative position, the magnetic brush is spaced therefrom. In FIG. 2, developer unit 40 is shown in the operative position with developer units 42, 44 and 46 being in the non-operative position. During development of each electrostatic latent image, only one developer unit is in the operative position, the remaining developer units are in the non-operative position. This insures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper (not shown) extends between belts 54 and moves in unison therewith. A sheet 150 is advanced from a stack of sheets 56 disposed on a tray. A friction retard feeder 58 advances the uppermost sheet from stack 56 onto a pre-transfer transport 60. Transport 60 advances sheet 150 to sheet transport 48. Sheet 150 is advanced by transport 60 in synchronism with the movement of sheet gripper 84. In this way, the leading edge of sheet 150 arrives at a preselected position, i.e. a loading zone, to be received by the open sheet gripper. The sheet gripper then closes, securing sheet 150 thereto for movement therewith in a recirculating path.

The leading edge of sheet 150 is secured releasably by the sheet gripper. As belts 54 move in the direction of arrow 62, the sheet moves into contact with the photoconductive belt, in synchronism with the toner image developed thereon. At transfer zone 64, a corona generating device 66 sprays ions onto the backside of the sheet so as to charge the sheet to the proper electrostatic voltage magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another. One skilled in the art will appreciate that the sheet may move in a recirculating path for four cycles when under color black removal is used and up to eight cycles when the information on two original documents is being merged onto a single copy sheet. Each of the electrostatic latent images recorded on the photoconductive surface is developed with the appropriately colored toner and transferred, in superimposed registration with one another, to the sheet to form the multi-color copy of the colored original document.

After the last transfer operation, the sheet gripper opens and releases the sheet. A conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure roll 72. In some applications, particularly in full color printers a heated pressure roll may also be utilized. The sheet passes through the nip defined by fuser roll 74 and pressure roll 72. The toner image contacts fuser roll 74 so as to be affixed to the sheet. Thereafter, the sheet is advanced by a pair of rolls 76 to catch tray 78 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

Figure 1:
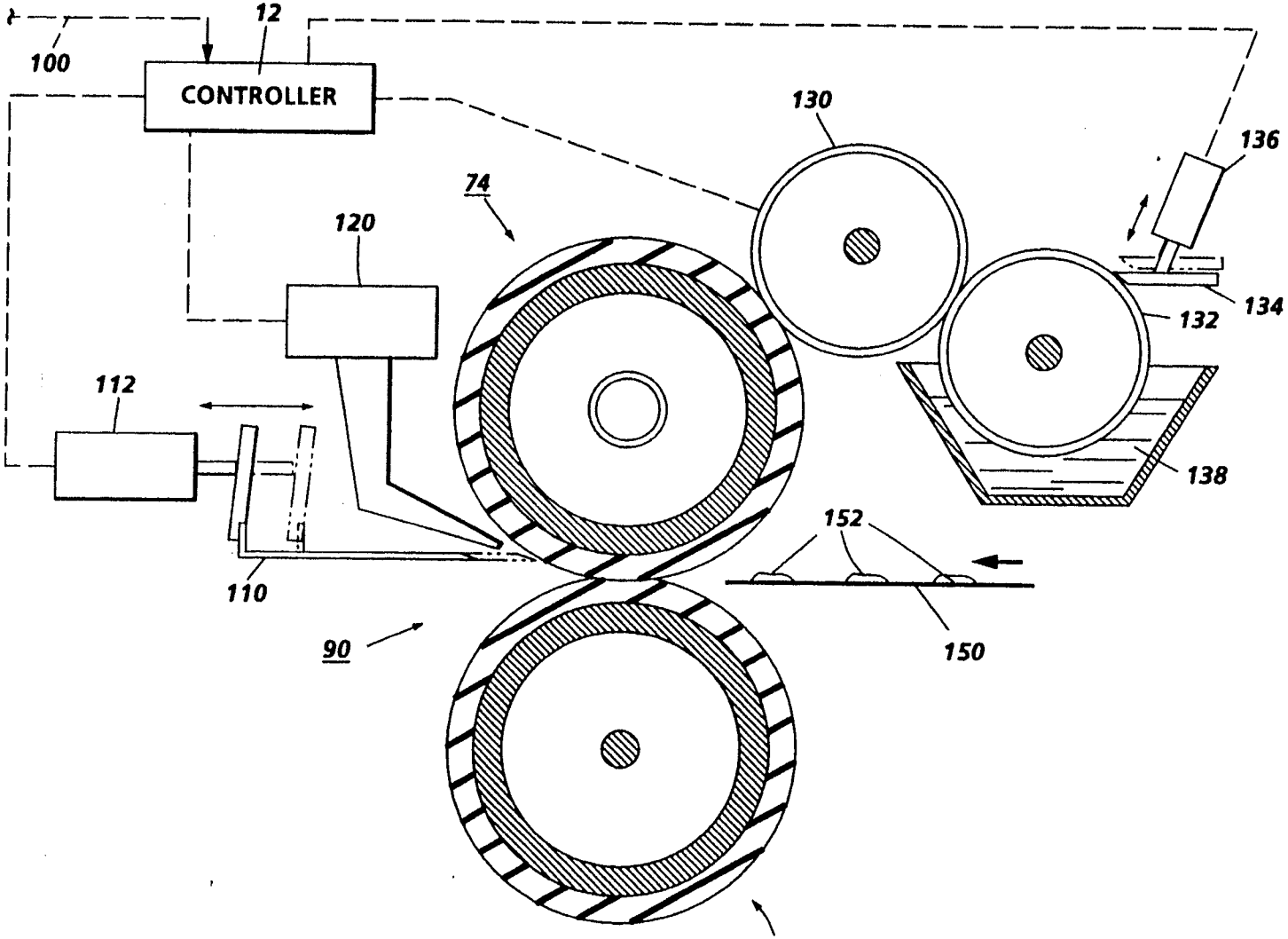
FIG. 1 is an elevational view of a fusing system incorporating the misstrip avoidance system of the present invention.

Attention is now directed to FIG. 1, which illustrates the fuser assembly and the misstrip preventive system. A sheet 150 with an unfused toner image 152 is shown entering the nip formed between the heated fuser roll 74 and pressure roll 72. A data stream 100 is shown being inputted to controller 200. The data stream 100 is made up of several types of information and will contain image information from the IPS, it will also also contain basis weight information from the basis weight detector 140, and will also contain moisture content information from humidity sensor 142. The basis weight detector can be of the type described in U.S. Pat. No. 5,138,178 which utilizes an infrared emitter and a phototransistor receptor to determine the weight of the sheet based on the voltage output variance of the phototransistor as the sheet passes between the emitter and receptor. The humidity sensor can be of the type utilized in the Xerox 5775 digital color copier.

In a light lens type copying machine which does not utilize an IPS, a densitometer or other sensor or array thereof can be utilized to determine image density on a sheet and emit a signal to the controller. Since the image has been developed, the patterns thereof are optically readable by illuminating them with a light emitter and sensing the patterns of reflected light. The sensor then emits a signal indicative of the density of the illuminated pattern. One such example of a densitometer is described in U.S. Pat. No. 5,053,822.

The controller 200 will then predict, based on the data received from the various sensors and the image data information, whether a sheet is likely to misstrip from the fuser roll 74. Certain characteristics such as light weight paper, heavy toner concentrations (dense image data), humid or moist paper, fuser roll age, fuser roll temperature and image location and combinations of the above conditions are known to promote fuser misstrips and fuser wrap. Fuser roll age can be determined by using High Frequency Service Item (HFSI) counters to track number of copies per fuser roll for each fuser roll that is installed in a printing machine.

One action that may be taken to prevent a misstrip would be to increase the amount of release agent 138 that is distributed to the fuser roll 74 by the metering roll 132 and donor roll 130. A doctor blade 134 can be pressed against the metering roll 132 through the use of an actuator 136 to increase or decrease the thickness of the release agent transferred from the metering roll to the donor roll 130. Thus, for heavily toned images or light or moist paper, an increase in release agent can be distributed onto the heated fuser roll which causes the sheet to release from the roll and not wrap. A varying speed metering roll donor brush RAM system such as that described in U.S. Pat. No. 5,200,786, commonly assiged to the assignee herein, may also be used to vary the amount of release agent on the fuser roll.

If necessary, further action can be instituted based upon the input data to prevent the fused sheet from wrapping on the fuser roll 74. An air jet 120 can be actuated by the controller to cause a jet of air to lift the leading edge of the fused sheet 150 from the fuser roll 74 thus preventing a misstrip. In more severe cases, a stripper finger 110 can be moved into position by actuator 112 to physically lift the lead edge of the fused sheet from the fuser roll 74. Both the stripper finger actuator 112 and the doctor blade actuator 136 may be simple two position solenoid type switches or variable position devices such as pneumatic cylinders, hydraulic cylinders, or other mechanically driven devices (ie. worm gears, rack and pinion, cams, etc.) which can be used to move the stripper finger 110 and/or the doctor blade 134 into or out of position.

Another action that could be instituted by the controller to increase the release agent transferred to the fuser roll 74 would be to skip a pitch on the photoreceptor between images thereby causing a greater amount of release agent to be transferred to the fuser roll due to the lack of a fused sheet passing between the nip created between the fuser roll 74 and the pressure roll 72. Depending on the type of image to be printed it is also possible to attenuate the density of the toner applied to the leading edge of the copy sheet thereby allowing easier stripping of the sheet from the fuser roll. This remedial action may be limited in application due to the potential of degrading the finished image quality.

Figure 2A:
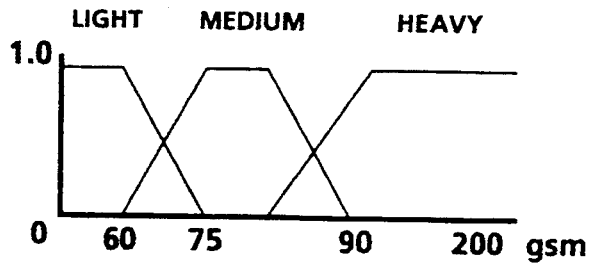
FIGS. 2A, 2B and 2C are graphical representations of representative membership functions which articulate the bounds of the input variables for paper weight, environment and image density respectively.
Figure 2B:
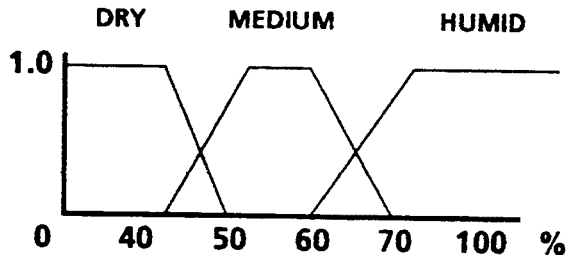
Figure 2C:
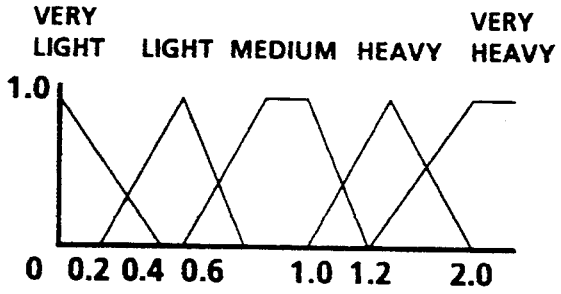

FIGS. 2A, 2B, and 2C illustrate graphically the membership functions for each input variable which mathematically define the linguistic variables used in the control rules. These functions can be used to calculate parameters upon which the degree of fuser misstrip avoidance procedures will be based. The functions illustrated define the bounds of the variables being measured so as to enable a weighing factor to be attributed to each variable as data is inputted. As an example, looking to FIG. 2A if a sheet were determined to have a weight of 65 grams per square meter it can be seen that this reading would be approximately 70% in the light range and 30% in the medium range. Thus the factor attributable to this weight paper would be a blend of both light and heavy. This weight factor in combination with the other determined variables is used to construct look up tables as is discussed below. This technique for blending variables is known as "fuzzy logic control" or "fuzzy control"

The development of a Fuzzy Logic Controller (FLC) requires three distinct steps:

(1) the fuzzification of input values where specific values of the controller inputs are mapped to the linguistic labels by means of the membership functions (2) a set of fuzzy if-then inferencing rules are developed which define relationship between the inputs and the outputs (3) a defuzzification process which converts the output labels selected by the application of the inputs to the rules back into numerical values.

Below in Table 1 is a example of a lookup table based on the functions illustrated in FIGS. 2A–2C inclusive, for fuser misstrip avoidance intensity as a function of lead edge image density and paper basis weight. The intensity value is given as a linguistic value of current nominal action (ie. oil rate) based on normal environment (for the purposes of this table humidity remains constant at a medium level).

TABLE 1

| Image → Paper ↓ | Very Light | Light | Medium | Heavy | Very Heavy |
|---|---|---|---|---|---|
| Light | HIGH | HIGH | HIGH | VERY HIGH | VERY HIGH |
| Medium | MEDIUM | MEDIUM | MEDIUM | HIGH | HIGH |
| Heavy | VERY LOW | VERY LOW | LOW | LOW | MEDIUM |

This lookup table can be interpreted as a set of fuzzy if-then rules. For example, we can read the first entry in table as If the Paper Basis Weight is Light AND the Image Area Coverage is Light THEN the Output Action is HIGH.

The output value is converted from a linguistic label to a numerical value by means of defuzzification. This requires that numerical values be assigned to each nominal output label. For example, an output value of high might be assigned a value of 90% (of full scale output), a medium output given 60% and a low output is 20%. This is shown in Table 2.

TABLE 2

| Linguistic Value → | Very Low | Low | Medium | High | Very High |
|---|---|---|---|---|---|
| Numerical Equivalent → | 25% | 40% | 60% | 90% | 125% |

In our example, the input values for paper basis weight (65 gsm) fell 70% in the light range (which calls for a HIGH output) and 30% fell in the medium range (which calls for a medium output), then if the output depended only on the value of the Basis Weight is computed by simple interpolation to be:

$$0.7\times(90\%)+0.3\times(60\%)=81\% \text{ of Full Scale Output}$$

As an example, for an intensity value of up to 0.9 a varying of the oil rate alone may be sufficient to prevent misstrips. Above a threshold intensity value of 0.9, a mechanical assist device such as an actuable stripper finger or a pneumatic knife may then be utilized to assist the stripping procedure. Other actions such as image attenuation at the leading edge of the sheet and/or pitch skipping may also be factored into the strategy depending on the application.

Similarly, tables can be constructed as a function of image density and environment condition where intensity is given as a fraction of current nominal intensity based on medium paper (Table 3) and as a function of paper weight and environment condition where intensity is given as a fraction of current nominal intensity based on medium image density as shown below in Table 4.

TABLE 3

| Image → Environment ↓ | Very Light | Light | Medium | Heavy | Very Heavy |
|---|---|---|---|---|---|
| Humid | MEDIUM | HIGH | HIGH | HIGH | VERY HIGH |
| Medium | LOW | MEDIUM | MEDIUM | MEDIUM | HIGH |
| Dry | LOW | LOW | LOW | MEDIUM | MEDIUM |

TABLE 4

| Paper → Environment ↓ | Light | Medium | Heavy |
|---|---|---|---|
| Humid | VERY HIGH | HIGH | MEDIUM |
| Medium | HIGH | MEDIUM | LOW |
| Dry | MEDIUM | MEDIUM | LOW |

Each of the above tables is variable in two dimensions and is based on three variables with one constant. To perform the avoidance strategy, three tables as shown above in Table 1 can be constructed, one each for dry, medium (or normal as shown) and humid environmental conditions. When the moisture content of the paper is determined and the proper table is selected, the image density and paper weight can then be inputted to the chosen table and the intensity of stripping action determined. If, for the example discussed above with reference to FIG. 2A, the initial variable is a blend of more than one range as discussed above, a multi-variable controller must be utilized. In the case of a multi-variable controller it becomes necessary to combine multiple rules. This is somewhat more complicated than the simple example given above. Consider the example above, with the addition of an Image Density Input of 1.05. As we can see from FIG. 2C, this results in an Image Density which has about 65% membership in the Normal range and 35% in the Heavy Range.

This then activates 4 rules from the total set since we must relate two values of Paper Basis Weight with two values of Image Density. These four rules are given below.

(1) If the Paper Basis Weight is Light AND the Image Area Coverage is Normal THEN the Output Action is HIGH.

(2) If the Paper Basis Weight is MediumAND the Image Area Coverage is Heavy THEN the Output Action is HIGH.

(3) If the Paper Basis Weight is Light AND the Image Area Coverage is Heavy THEN the Output Action is VERY HIGH.

(4) If the Paper Basis Weight is Medium AND the Image Area Coverage is Normal THEN the Output Action is MEDIUM.

Recall that the weights were 70% for light paper and 30% for medium, while the Image Density was split 65–35% between medium and heavy. This gives rise to the following.

TABLE

| | Defuzzification | | |
|---|---|---|---|
| Rule | Paper | Image | Output |
| 1 | 70% | 65%* | HIGH |
| 2 | 30%* | 35% | HIGH |
| 3 | 70% | 35%* | VERY HIGH |
| 4 | 30%* | 65% | MEDIUM |

Notice that the minimum input (antecedent0 for each rule has an asterisk next to it. We use the minimum antecedent for each rule and then choose the maximum support level for each output (consequent). So in this example, we support the HIGH output at a 65% level from Rule 1, while at the same time we support MEDIUM at the 30% level from Rule 4. We don't use the output of Rule 2 since we already have support for HIGH and we don't use the output of Rule 3 since we already have a consequence of Image Area Coverage. Thus using our weighted interpolation as we did in the previous example we get:

$$0.65\times(90\%)+0.3\times(60\%)=76.5\% \text{ of Full Scale Output}$$

In recapitulation, there is provided an apparatus for minimizing fuser misstrips from a heat and pressure fuser in an electrophotographic printing machine. A plurality of sensors are provided to determine the basis weight of the copy sheet, the density of the image being transferred to the copy sheet and fused thereon, the relative humidity of the machine environment, the process speed of the print engine, etc. Signals indicative of all the variables are generated and sent to the machine controller which processes these signals and predicts when a fuser misstrip is likely to occur. Based on the likely degree of misstrip, a variety of actions are taken to prevent the misstrip. A stripper finger or other mechanical stripping deviice can be actuated to physically remove the sheet from the fuser member and/or the release agent management system can vary the amount of release agent applied to the fuser to assist in the removal of the copy sheet from the heated fuser member. The overall system provides the advantage of a varying amount of fuser release agent so that an extreme buildup of oil is not encountered, and further allows intermittent stripper finger or other mechanical device use to prevent premature wear of the fuser member by the constant pressure of a stripper finger.

It is, therefore, apparent that there has been provided in accordance with the present invention, a system and method to minimize fuser misstrips that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A printing machine in which a toner image is fused to a sheet by a fuser, wherein the improvement comprises:

means for determining at least one of a plurality of parameters effecting separating the sheet from the fuser and generating a signal indicative thereof;

a plurality of sheet separating devices, each of said plurality of sheet separating devices having a different operational mode to effect the sheet separating function; and a controller, responsive to the signal from said determining means, for selecting at least one of said plurality of sheet separating devices to separate the sheet from the fuser.

2. A printing machine according to claim 1, wherein said selected one of said sheet separating device comprises a stripper finger mounted adjacent the fuser and actuable in response to a signal from the controller so as to move into a position to remove a sheet from the fuser member.

3. A printing machine according to claim 1, wherein said selected one of said sheet separating device comprises a pneumatic air jet actuated by a signal from said controller.

4. A printing machine according to claim 1, wherein said determining means comprises means for determining the fuser roll temperature and generating a signal indicative thereof.

5. A printing machine in which a toner image is fused to a sheet by a fuser, wherein the improvement comprises:

means for determining at least one of a plurality of parameters effecting separating the sheet from the fuser and generating a signal indicative thereof, said determining means comprises means for determining the density of the image and generating a signal indicative thereof;

a plurality of sheet separating devices; and a controller, responsive to the signal from said determining means, for selecting at least one of said plurality of sheet separating devices to separate the sheet from the fuser.

6. A printing machine in which a toner image is fused to a sheet by a fuser, wherein the improvement comprises:

means for determining at least one of a plurality of parameters effecting separating the sheet from the fuser and generating a signal indicative thereof, said determining means comprises means for determining the sheet moisture content and generating a signal indicative thereof;

a plurality of sheet separating devices; and a controller, responsive to the signal from said determining means, for selecting at least one of said plurality of sheet separating devices to separate the sheet from the fuser.

7. A printing machine according to claim 6, wherein said determining means further comprises, means for determining the density of the image and generates a signal indicative thereof, said controller being adapted to receive the signal from said density determining means and the signal from said moisture determining means and, in response thereto, selecting at least one of said plurality of sheet separating devices.

8. A printing machine in which a toner image is fused to a sheet by a fuser, wherein the improvement comprises:

means for determining at least one of a plurality of .parameters effecting separating the sheet from the fuser and generating a signal indicative thereof, said determining means comprises means for determining the basis weight of a sheet and generating a signal indicative thereof;

a plurality of sheet separating devices; and a controller, responsive to the signal from said determining means, for selecting at least one of said plurality of sheet separating devices to separate the sheet from the fuser.

9. A printing machine according to claim 8, wherein said determining means further comprises, means for determining the density of the image and generates a signal indicative thereof, said controller being adapted to receive said signal from said density determining means and the signal from said basis weight determining means and, in response thereto, selecting at least one of said plurality of sheet separating devices.

10. A printing machine according to claim 9, wherein said determining means further comprises, means for determining the moisture content of the sheet and generates a signal indicative thereof, said controller being adapted to receive the signal from said moisture determining means, the signal from said density determining means and the signal from said basis weight determining means and, in response thereto, selecting at least one of said plurality of sheet separating devices.

11. A printing machine according to claim 8, wherein said determining means further comprises, means for determining the moisture content of the sheet and generates a signal indicative thereof, said controller being adapted to receive the signal from said moisture determining means and the signal from said basis weight determining means and, in response thereto, selecting at least one of said plurality of sheet separating devices.

12. A printing machine in which a toner image is fused to a sheet by a fuser, wherein the improvement comprises:

means for determining at least one of a plurality of parameters effecting separating the sheet from the fuser and generating a signal indicative thereof;

a plurality of sheet separating devices; and a controller, responsive to the signal from said determining means, for selecting at least one of said plurality of sheet separating devices to separate the sheet from the fuser, said selected one of said sheet separating device comprises a variable rate release agent management system wherein the amount of release agent applied to the fuser member is varied in response to the signal received from said controller.

13. A printing machine in which a toner image is fused to a sheet by a fuser, wherein the improvement comprises:

means for determining at least one of a plurality of parameters effecting separating the sheet from the fuser and generating a signal indicative thereof, said determining means comprises means for determining the fuser roll age and generating a signal indicative thereof;

a plurality of sheet separating devices; and a controller, responsive to the signal from said determining means, for selecting at least one of said plurality of sheet separating devices to separate the sheet from the fuser.

14. A printing machine in which a toner image is fused to a sheet by a fuser, wherein the improvement comprises:

means for determining at least one of a plurality of parameters effecting separating the sheet from the fuser and generating a signal indicative thereof, said determining means comprises means for determining the image location on a sheet and generating a signal indicative thereof;

a plurality of sheet separating devices; and a controller, responsive to the signal from said determining means, for selecting at least one of said plurality of sheet separating devices to separate the sheet from the fuser.

15. A method for predicting and preventing fuser misstrips in a printing machine comprising the steps of:

determining at least one of a plurality of parameters effecting separating a sheet from the fuser and generating a parameter signal indicative thereof;

selecting, in response to the parameter signal, at least one of a plurality of sheet separating devices, each of said plurality of sheet separating devices having a different operational mode to effect the sheet separating function, to separate the sheet from the fuser; and actuating at least one of a plurality of sheet separating devices for removing a sheet from the fuser.

16. The method according to claim 15, wherein said actuating step comprises, activating a stripper finger to contact the fuser so as to physically remove the sheet from the fuser.

17. The method according to claim 15, wherein said actuating step comprises, activating an air jet to lift a lead edge of the sheet so as to physically remove the copy sheet from the fuser.

18. A method for predicting and preventing fuser misstrips in a printing machine comprising the steps of:

determining at least one of a plurality of parameters effecting separating a sheet from the fuser and generating a parameter signal indicative thereof, said determining step comprises determining the density of the image and generating a signal indicative thereof;

selecting, in response to the parameter signal, at least one of a plurality of sheet separating devices to separate the sheet from the fuser; and actuating at least one of a plurality of sheet separating devices for removing a sheet from the fuser.

19. A method for predicting and preventing fuser misstrips in a printing machine comprising the steps of:

determining at least one of a plurality of parameters effecting separating a sheet from the fuser and generating a parameter signal indicative thereof, said determining step comprises determining the moisture content of the sheet and generating a signal indicative thereof;

selecting, in response to the parameter signal, at least one of a plurality of sheet separating devices to separate the sheet from the fuser; and actuating at least one of a plurality of sheet separating devices for removing a sheet from the fuser.

20. A method according to claim 19, wherein said determining step further comprises, determining the density of the image and generating a signal indicative thereof, said selecting step receiving said image density signal and said moisture signal to select at least one of said plurality of sheet separating devices.

21. A method for predicting and preventing fuser misstrips in a printing machine comprising the steps of:

determining at least one of a plurality of parameters effecting separating a sheet from the fuser and generating a parameter signal indicative thereof, said determining step comprises determining the basis weight of a sheet and generating a signal indicative thereof;

selecting, in response to the parameter signal, at least one of a plurality of sheet separating devices to separate the sheet from the fuser; and actuating at least one of a plurality of sheet separating devices for removing a sheet from the fuser.

22. A method according to claim 21, wherein said determining step further comprises, determining the density of the image and generating a signal indicative thereof, said selecting step receiving said image density signal and said basis weight signal to select at least one of said plurality of sheet separating devices.

23. A method according to claim 22, wherein said determining step further comprises, determining the moisture content of the sheet and generating a signal indicative thereof, said selecting step receiving said moisture content signal, said image density signal and said basis weight signal to select at least one of said plurality of sheet separating devices.

24. A method according to claim 21, wherein said determining step further comprises, determining the moisture content of the sheet and generating a signal indicative thereof, said selecting step receiving said moisture content signal and said basis weight signal to select at least one of said plurality of sheet separating devices.

25. A method for predicting and preventing fuser misstrips in a printing machine comprising the steps of:

determining at least one of a plurality of parameters effecting separating a sheet from the fuser and generating a parameter signal indicative thereof;

selecting, in response to the parameter signal, at least one of a plurality of sheet separating devices to separate the sheet from the fuser; and actuating at least one of a plurality of sheet separating devices for removing a sheet from the fuser, said actuating step comprises, varying the amount of a release agent deposited on the fuser so as to allow the copy sheet to strip from the fuser.

* * * * *